US005261699A

United States Patent [19]

Marston

[11] Patent Number: 5,261,699

[45] Date of Patent: Nov. 16, 1993

[54] FOOTREST FOR A SKI POLE

[76] Inventor: Philip W. Marston, 8-B Packet Landing, Pembroke, Mass. 02359

[21] Appl. No.: 959,331

[22] Filed: Oct. 13, 1992

[51] Int. Cl.[5] ..... A63C 11/22

[52] U.S. Cl. ..... 280/819; 280/816

[58] Field of Search ..... 280/809, 816, 819; 135/66

[56] References Cited

U.S. PATENT DOCUMENTS

| | | | |
|---|---|---|---|
| 4,196,742 | 4/1980 | Owen, Jr. | 280/816 X |
| 4,299,409 | 11/1981 | Gedicks | 280/189 |
| 4,341,400 | 7/1982 | Morgan | 280/819 |
| 4,358,138 | 11/1982 | Laughlin et al. | 280/819 |
| 4,582,341 | 4/1986 | Erickson | 280/819 X |
| 4,589,681 | 5/1986 | Erickson | 280/819 |
| 4,718,138 | 1/1988 | Brown et al. | 280/819 X |
| 5,056,545 | 10/1991 | Spaeth | 135/66 |

FOREIGN PATENT DOCUMENTS

| | | | |
|---|---|---|---|
| 13226 | 9/1903 | Austria | 135/66 |
| 2140450 | 3/1973 | Fed. Rep. of Germany | 280/816 |
| 80855 | 10/1952 | Sweden | 280/819 |
| 2020967 | 11/1979 | United Kingdom | 135/66 |

*Primary Examiner*—Brian L. Johnson
*Attorney, Agent, or Firm*—James H. Grover

[57] ABSTRACT

Attachments to a standard ski pole include a hook assembly clamped to the upper end of the ski pole, and a footrest crosspiece at the lower end of the pole which is rotatable from a retracted position parallel to the pole to an operative position transverse the pole. In use the hook is hung over a member of a ski lift, and the footrest is pivoted to transverse position where it can support the skier's feet.

11 Claims, 3 Drawing Sheets

FOOTREST FOR A SKI POLE

BACKGROUND OF THE INVENTION

A common form of cable-supported lift for carrying skiers up a slope is a chair in which the skier sits wearing skis with his legs hanging free and unsupported below the chair. In such a lift a tiring strain is placed on the skier's legs and knees, and the seat cuts into the under side of the upper leg. It is the object of the present invention to relieve the strain and discomfort on the skier's legs.

SUMMARY OF THE INVENTION

According to the invention an attachment for a skier's ski pole is provided which comprises a footrest crosspiece normally extending in a position transverse the lower end of the pole to a length adequate to support boots, with or without skis, at each side of the pole, with means extending from the middle of the crosspiece and encircling the pole for securing the crosspiece to the pole. Preferably the crosspiece is rotatable from its transverse position to a position parallel to the pole for use in skiing. Further the ski pole is provided with a hook device for engaging a safety bar member on the lift so as to support the pole and footrest on the lift.

DRAWINGS

DESCRIPTION

Figure 1A:
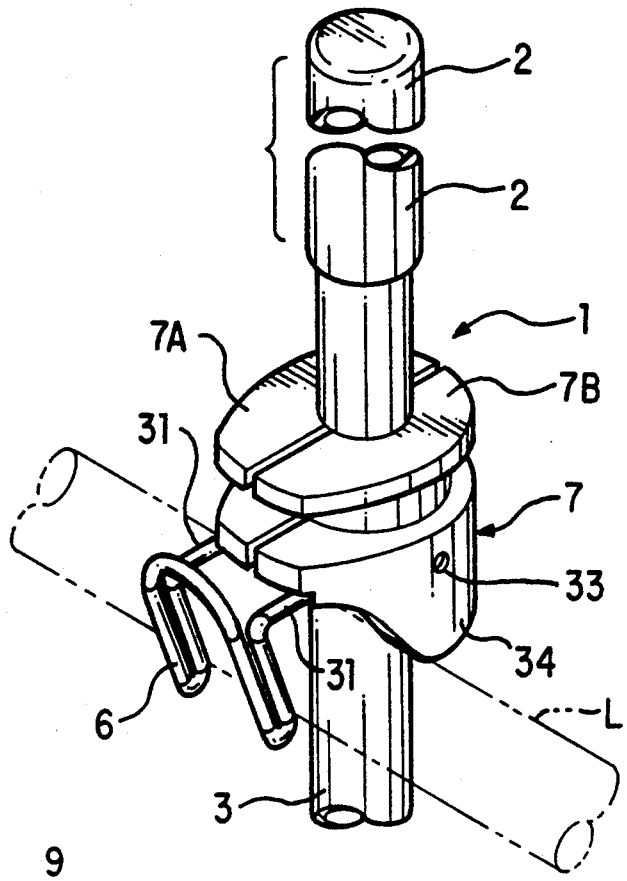
FIG. 1A is an isometric view of the upper end of a ski pole with a support hook according to the invention.
Figure 1B:
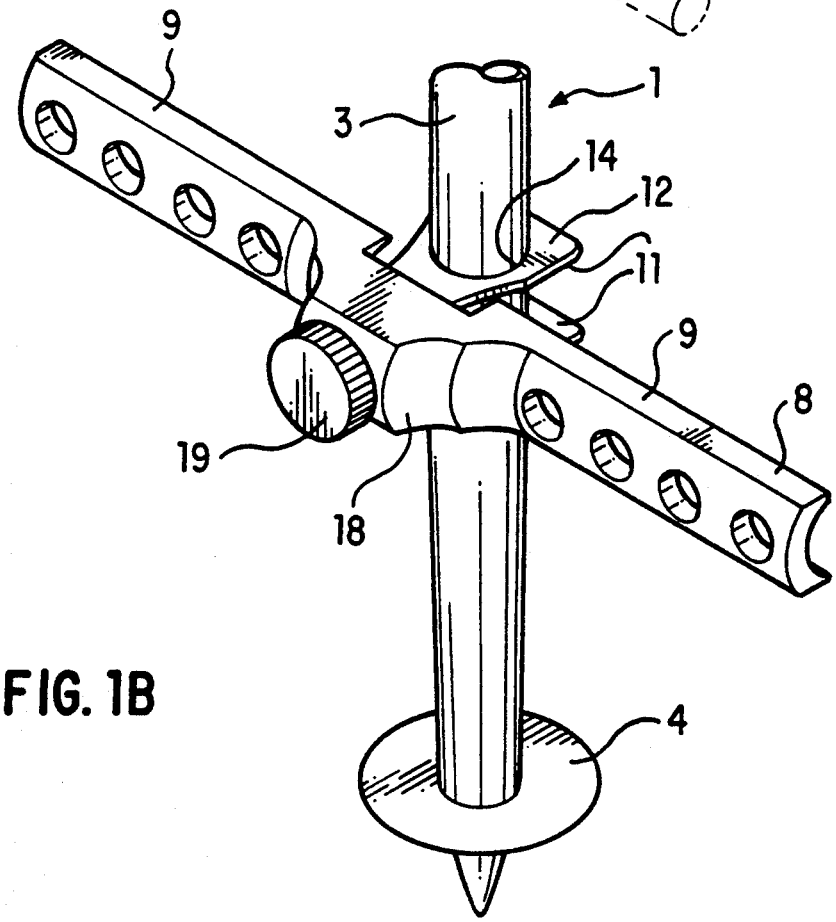
FIG. 1B is an isometric view of the lower end of the ski pole with a footrest crosspiece.

The upper and lower ends respectively of a ski pole are shown in FIGS. 1A and 1B. The pole has the customary hand grip 2, tubular shaft 3, and basket 4. At the upper end of the pole is a pole attachment device including a hook 6 adapted to hang the pole from a horizontal member L on the lift, and body 7 for clamping the hook to the pole. At the lower end of the pole is another pole attachment comprising a footrest crosspiece 8 shown extending transversely of the pole, the footrest having portions 9 at either side of the pole for supporting the boots of a skier sitting on the lift, with or without skis. The footrest is preferably of a strong, lightweight material such as aluminum or a glass filled resin such as nylon. The hook attachment body 7 is of nylon or similar strong, lightweight plastic.

Figure 2:
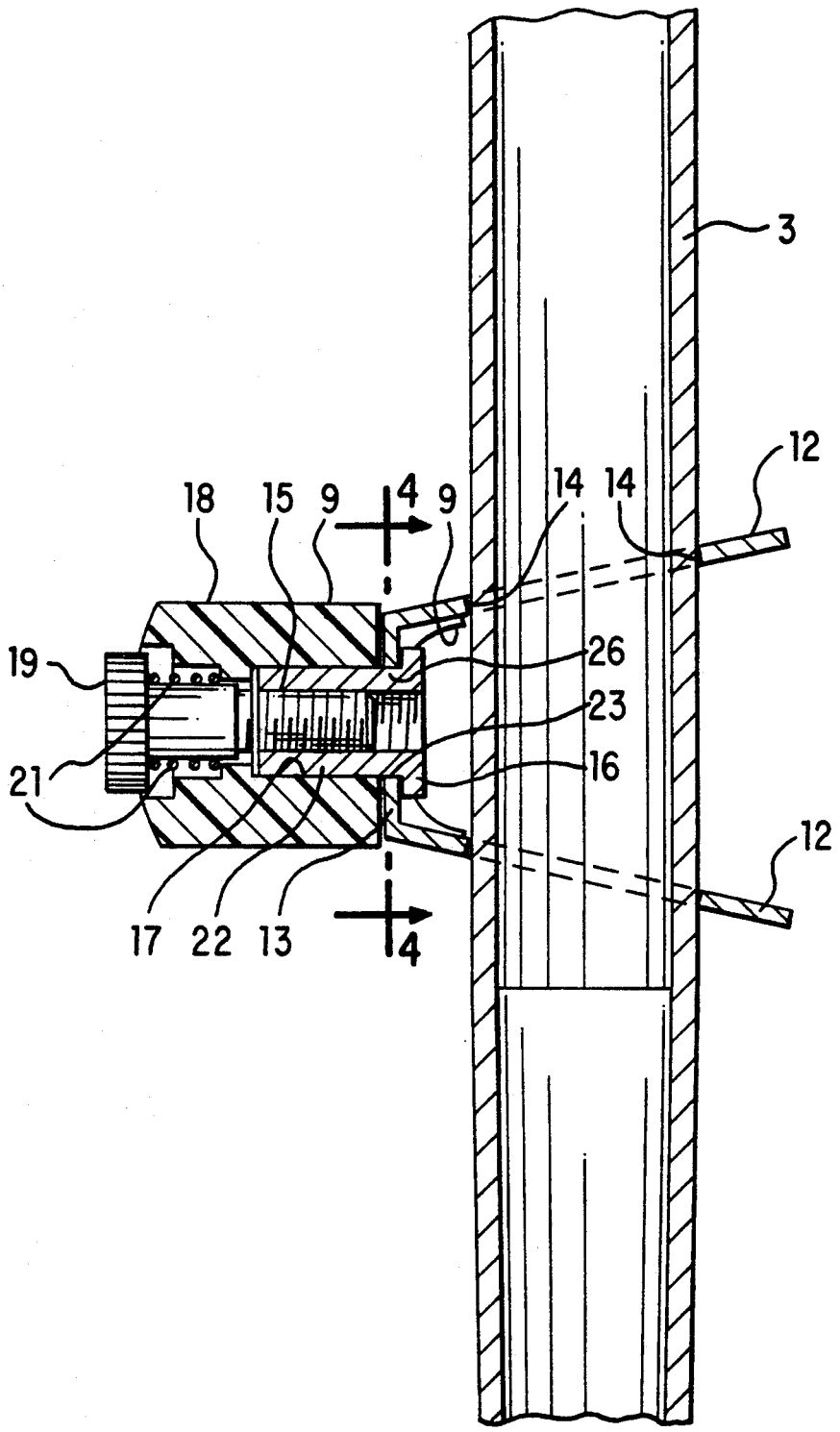
FIG. 2 is a vertical section through the center of the crosspiece at twice the scale of FIG. 1B.

As shown in FIGS. 1B and 2, the crosspiece has a U-shaped securing member 11 of spring metal with upper and lower leafs 12 extending at an angle of approximately 75 degrees to a base 13. Each leaf has an circular opening 14 encircling the tubular shaft 3 of the pole. The spring of the member causes the edges of the openings to bite the shaft 3 of the pole. Squeezing the two leafs together with thumb and finger releases the bite allowing the crosspiece to be adjusted up and down the shaft according to the height of the skier.

Figure 4:
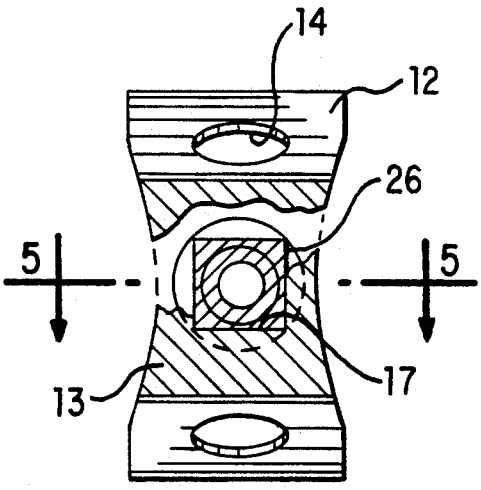
FIG. 4 is a section on line 4—4 of FIG. 2, partly broken away.
Figure 5:
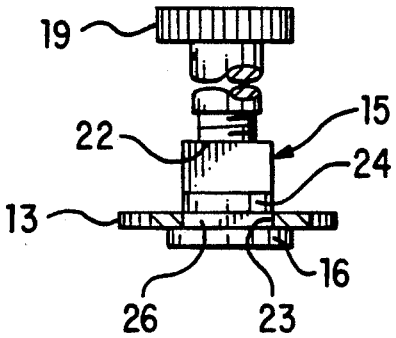
FIG. 5 is a section on line 5—5 of FIG. 4.

As shown in detail in FIGS. 2, 4 and 5, the base 13 of the spring member is attached to the crosspiece by a plunger 15 with a head 16. The plunger has a rectangular shank portion 22 sliding in a rectangular passage 17 through the hub 18 of the crosspiece 9. As shown in FIG. 2 the rectangular shank portion 22 of the plunger is normally engaged in a rectangular passage 17 in the base 13, as well as in a rectangular opening 23 in the base 13. The plunger acts as a spring detent to prevent rotation of the crosspiece relative to the base and pole. Between the rectangular shank portion 22 and its head 16 the plunger has a cylindrical portion 24 and a second rectangular portion 26 normally seated in the rectangular opening 23 in the base 13 (FIG. 5). The plunger is connected to a button 19 urged outwardly by a spring 21. Depressing the button disengages the second rectangular portion 26 from the base opening 23, replacing it with the cylindrical portion 24, and allowing pivotal rotation of the rectangular opening 23 of the crosspiece base around the cylindrical portion 26. The crosspiece can then be rotated between a retracted position parallel to the pole shaft where it will not interfere with normal skiing use of the pole and the transverse position used to support the skier's feet.

Figure 3:
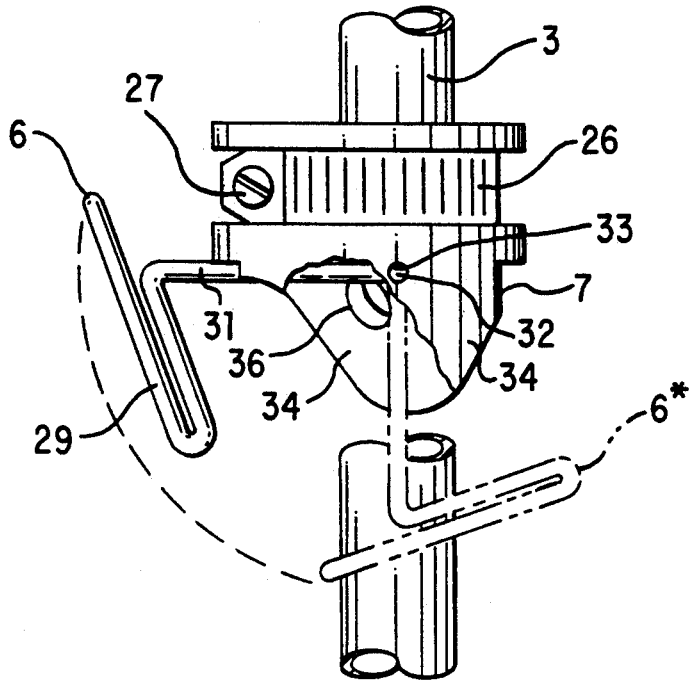
FIG. 3 is a side elevation of the support hook, partly broken away.

As shown in FIGS. 1A and 3, the hook support body 7 comprises two halves separable for attaching the body to the ski pole, and a metal strap 26 tightened by a screw 27 to clamp the halves securely on the shaft. Alternatively the halves 7A and 7B may be bolted together. The hook for hanging the ski pole on the lift member L is formed of heavy wire doubled at its outer, hook shaped end 29, and extending inwardly to two free ends 31 with outwardly bent tips 32. The tips spring yieldingly into openings 33 in two flanges 34 depending from the body allowing the hook to be swung from its operative position shown in solid line in FIGS. 1A and 3, to the retracted position shown in phantom in FIG. 3 for use of the pole in skiing. A boss 36 in the path of the free hook ends 31 acts as a detent to latch the hook in either position.

For use in a typical ski lift seat with a safety bar member in front of the skier, the hook is swung to its outer position and the pole is hung on the safety bar member after the footrest has been swung to transverse position. The pole and crosspiece will then support the skiers legs comfortably.

It should be understood that the present disclosure is for the purpose of illustration only, and that the invention includes all modifications and equivalents falling within the appended claims.

I claim:

1. A skiers' aid adapted for attachment to a ski pole for use on a ski lift comprising:

a footrest crosspiece normally extending in a position transverse to the lower end of the pole, and of length to support a boot at each side of the pole;

means at the middle of the crosspiece including means encircling the longitudinal axis of the pole for pivotally securing the footrest crosspiece to the pole so as to allow the crosspiece to move between an adjusted position transverse of the axis and an adjusted position parallel to the axis; and the pivotal securing means including a movable detent connected therewith for positively latching the crosspiece in the transverse or parallel position, and an interconnected spring holding the detent in latching position.

2. An attachment according to claim 1 wherein the securing means includes a release plunger unlatching the detent for adjustment.

3. An attachment according to claim 1 wherein the spring includes a resilient leaf with a circular opening therethrough with an edge able to bite a ski pole shaft.

4. An attachment according to claim 1 in combination with a ski pole.

5. An attachment according to claim 4 in combination with a hook device attached to the ski pole shaft having a clip shaped to engage and hang on a horizontal member so as to support the pole and footrest on a ski lift.

6. An attachment according to claim 5 the hook device including a body secure to the ski pole shaft and means pivotally connecting the clip to the body to allow the clip to swing between a retracted position embracing the ski pole and a position extended to engage a ski lift member.

7. A skier's aid for use on a ski lift with a member at the skiers location thereon comprising:

a ski pole with a tubular shaft;

a footrest crosspiece extending in a position transverse the lower end of the pole, and of length to support a ski boot at each side of the pole; and means at the middle of the crosspiece including means encircling the longitudinal axis of the pole for pivotally securing the crosspiece to the pole so as to allow the footrest cross piece to adjust between a position transverse of the pole axis and a position parallel to the axis;

the pivotal securing means including a movable detent connected therewith for positively latching the crosspiece in the transverse or parallel position, and an interconnected spring holding the detent in latching position a hook device attached to the shaft for engaging the ski lift member so as to support the pole, footrest cross piece and skier's boots.

8. A skier's aid according to claim 7 wherein the securing means includes a release plunger unlatching the detent for adjustment.

9. A skier's aid according to claim 7 wherein the securing means includes a spring member yieldingly gripping the ski pole.

10. A skier's aid according to claim 9 wherein the spring member includes a resilient leaf with an circular opening therethrough with edges able to bite the ski pole shaft.

11. A skier's aid according to claim 7 wherein the hook device includes means pivotally connecting the clip to a clamping body secured to the ski pole shaft to swing between a retracted position embracing the ski pole and a position to engage the ski lift member.

* * * * *